US005168744A

United States Patent [19]

Heitze

[11] Patent Number: 5,168,744

[45] Date of Patent: Dec. 8, 1992

[54] APPARATUS FOR REPLACING PRESSING DIES IN UPSETTING PRESS

[75] Inventor: Gerhard Heitze, Netphen, Fed. Rep. of Germany

[73] Assignee: SMS Schloemann-Siemag Aktiengesellschaft, Dusseldorf, Fed. Rep. of Germany

[21] Appl. No.: 760,170

[22] Filed: Sep. 16, 1991

[30] Foreign Application Priority Data

Sep. 17, 1990 [DE] Fed. Rep. of Germany ..... 4029429

[51] Int. Cl.[5] ..... B21J 13/10

[52] U.S. Cl. ..... 72/446; 72/184; 72/406

[58] Field of Search ..... 72/446, 448, 406, 407, 72/184, 189; 29/568

[56] References Cited

U.S. PATENT DOCUMENTS

| | | | |
|---|---|---|---|
| 3,816,904 | 6/1974 | Herb | 72/446 |
| 3,821,844 | 7/1974 | Harman | 29/568 |
| 3,834,218 | 9/1974 | Kralowetz | 72/446 |
| 5,077,999 | 1/1992 | Rohde | 72/184 |

FOREIGN PATENT DOCUMENTS

| | | | |
|---|---|---|---|
| 1-57728 | 6/1989 | Japan | 72/446 |
| 6004 | 1/1990 | Japan | 72/446 |
| 984873 | 1/1983 | U.S.S.R. | 72/446 |

*Primary Examiner*—Daniel C. Crane

*Attorney, Agent, or Firm*—Anderson Kill Olick & Oshinsky

[57] ABSTRACT

For replacing pressing dies (7) in an upsetting press (1) used for width reduction of rolled material, such as for reducing slab width in hot rolled wide strip shaping trains, the width reduction is effected by the pressing dies (7) held in die carriers (8). The pressing dies (7) face one another and are located on the opposite sides of the slab. The die carriers (8) are moved in the reduction direction by a drive system (11) and are guided in a horizontal press stand containing stand beams (6). A displacement trolley (19) having a hoisting frame (20) including a hoisting drive (21) with a support mounting (22) on the hoisting frame (20) for receiving a pressing die (7). The apparatus is arranged for completely automatic replacement of the pressing dies (7). In addition, a movable carrier trolley (23) with a least one depositing location (24, 25) for a pressing die is provided for receiving worn pressing dies and for supplying replacement pressing dies.

14 Claims, 4 Drawing Sheets

APPARATUS FOR REPLACING PRESSING DIES IN UPSETTING PRESS

BACKGROUND OF THE INVENTION

The present invention is directed to an apparatus for replacing pressing dies in an upsetting press used for width reduction of rolled material, such as the reduction of a slab width in a hot rolled wide strip shaping train in which die carries are arranged along opposite sides of the slab for supporting the pressing dies. A drive system moves the die carriers in the reducing direction in a horizontal stand between stand beams.

In German patent application P 39 17 398.4 an upsetting press is described with pressing dies supported in die carriers and located on the opposite slab edges for reduction of the slab width in a hot rolled wide strip shaping train. In the reduction drive, each pressing die along with its die carrier is moved in the direction of width reduction of the slab by a guide system actuated by a crank drive located within a crank housing. The crank drive is made up of two powered eccentric shafts with a connecting rod supported on each eccentric shaft and the head of each connecting rod is attached to the die carrier for transmitting the upsetting forces. A feed drive acting basically in the direction of the slab feed engages the die carrier. Such measures permit the control of the motion sequence of the pressing dies for the required reduction and for the feed of the pressing dies separately from one another. If the feed drive is an hydraulic drive, the displacement motion of the hydraulic cylinder can be controlled in a particularly effective manner in the form of a travel-time function whereby the synchronization of the motion of the pressing dies with the motion of the slab to be pressed from the sides is assured for every possible feed magnitude. This upsetting press enables a continuous reduction of the slab width to values preset by rolling technology. Such an arrangement of the upsetting press assures its high availability, so that a high productivity of the mill train, including the upsetting press, is assured.

SUMMARY OF THE INVENTION

Therefore, it is a primary object of the present invention to improve this known upsetting press, especially to increase the availability of the upsetting press and to automate as much as possible the replacement of the pressing dies and to perform the replacement in a mechanized manner, that is, without manual intervention of the maintenance personnel in the replacement operation.

In accordance with the present invention, at least one vertically extending hoisting frame with a hoisting drive is arranged in the horizontal stand. A support mounting is positioned on the hoisting frame and is arranged to receive a pressing die. A displaceable trolley supports the hoisting frame and a displaceable carrier trolley is arranged with depositing locations for receiving a pressing die from or supplying a pressing die to the support mounting. With the die replacement apparatus arranged in this manner, a worn pressing die can be replaced completely automatically with a reconditioned pressing die and can be placed in the operating position. A crane is available for handling pressing dies at the carrier trolley. In a preferred embodiment, the displacement trolley is movable on a rail arrangement extending along the stand beams, and the pressing die support mounting can be lifted and lowered by the hoisting drive on the hoisting frame through a window defined by the stand beams while the displaceable carrier trolley is movable over a rail arrangement extending transversely of the stand beams. Accordingly, a pressing die can be guided in two planes of motion for greatly facilitating the control of the replacement operation.

Therefore, as a further refinement of the die replacement apparatus, the displacement trolley and the displaceable carrier trolley are displaceable by a travel-controlled displacement arrangement, preferably by a double acting piston cylinder unit using a pressure medium with the displacement arrangement abutting against the stand beams of the stand or against a lateral tie. The travel or movement of the displacement trolley and the displaceable carrier trolley, as a consequence, are controlled in a very precise manner, whereby all mechanical coupling or uncoupling steps of the pressing die and the die carrier, the transfer of the pressing die from the displacement trolley, and the placement of the pressing die on the carrier trolley can be effected in a very precise manner and in randomly repetitive processes.

A particularly effective feature of the replacement apparatus for the pressing dies in the upsetting press is the arrangement of the hoisting drive for the hoisting frame on the displacement trolley, with the frame retained in a roller guide on the displacement trolley. The resulting compact construction of the displacement trolley is further improved by another feature of the invention in which the hoisting drive includes a preferably hydraulic motor with gear box and impulse counter as well as a connector coupling to a shaft supported in pedestal bearings with at least one pinion meshing with a toothed rack fastened on the hoisting frame.

Yet another feature of the invention is the provision for a secure engagement of the pressing die in the supporting mounting on the hoisting frame, in which the support mounting has two side straps extending on opposite ends of the pressing die and a central strap positioned below the pressing die. Each of the side straps has a recess for receiving a support pin or carrier bolt fastened to the end of the pressing die. As a result, the pressing die is grasped at both ends and from below by the support mounting and is held securely in this way, so that the pressing die can be removed from the die carrier hydraulically by remote control and thus can be released for removal.

Still another feature of the replacement apparatus is the provision of two depositing locations for the pressing die on the carrier trolley, the locations spaced apart in the direction of movement of the carrier trolley. As a result, a new or replacement pressing die to be installed can be placed on the carrier trolley. The worn die can be moved from the support mounting in the hoisting frame onto the carrier trolley after being removed from the die carrier, while, at the same time, the new or replacement die is moved into position to be picked up by the support mounting on the hoisting frame.

Finally, another feature of the replacement apparatus is the provision of a replacement device for each of the pressing dies, so that die replacement can be carried out in the upsetting press on the opposite sides of the slab, independently of one another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
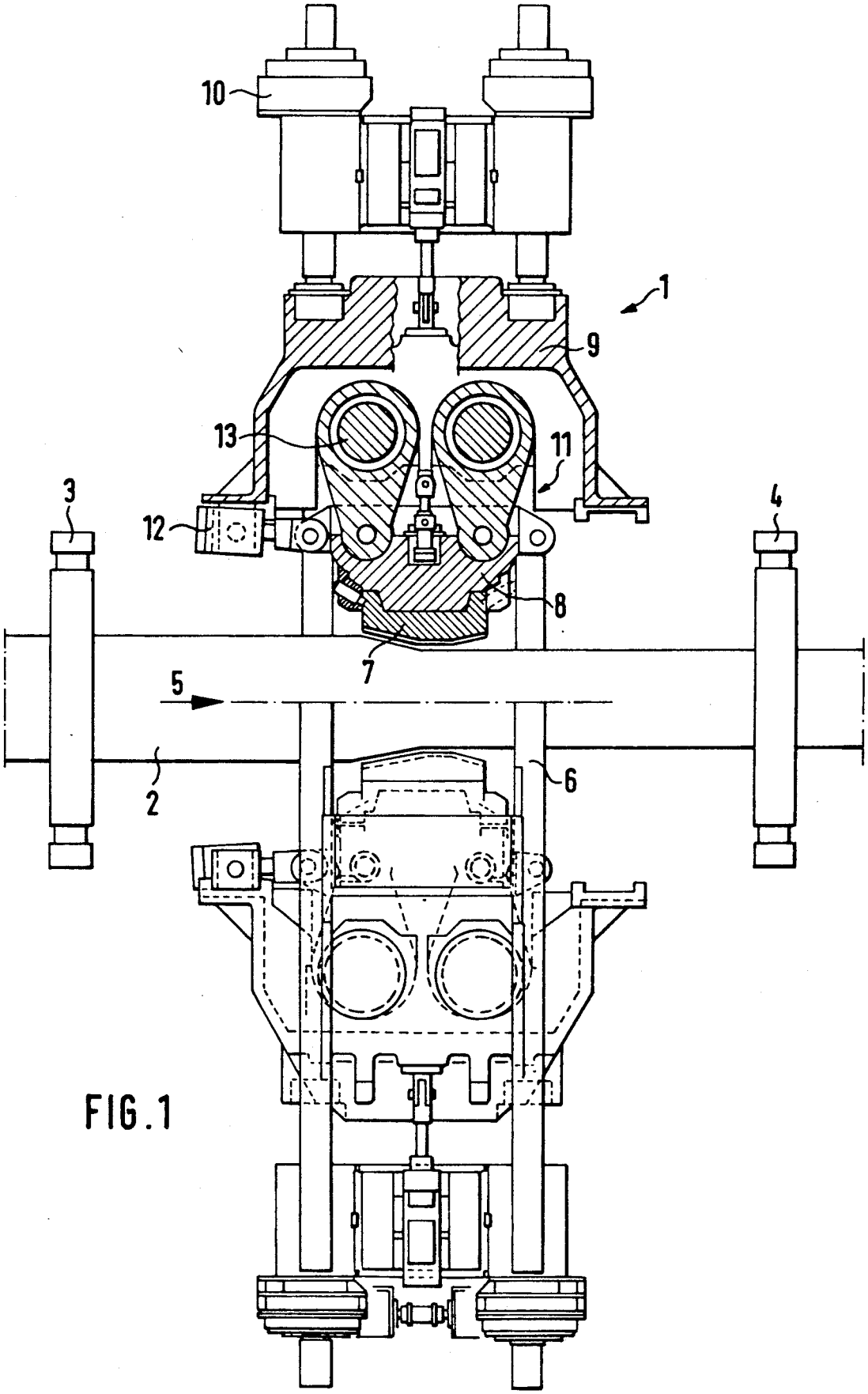
FIG. 1 is a plan view, partly in horizontal section, of an upsetting press embodying the present invention.

In FIG. 1 a horizontal section through an upsetting press 1 is shown in which the press is operated in a flying or suspended manner for reducing the width of slabs 2 in a hot rolled wide strip shaping train, where the slabs are supplied nearly continuously by a slab casting plant, not shown, located upstream of the upsetting press. Powered rollers 3, 4 are arranged upstream and downstream of the upsetting press in the direction of movement of the slabs. Slab 2 passes through the slab upsetting stand in the direction indicated by the arrow 5. The upsetting press has horizontally arranged stand beams 6. A crank housing 9 is adjustably guided on the stand beams of the upsetting press. The adjustment of the crank housing 9 is effected by a mechanical adjustment device 10. A hydraulically acting piston cylinder could also be used as the adjustment device.

A pressing die 7, secured on a die carrier 8, is arranged on each of the opposite sides of the slab 2. Each pressing die 7 and die carrier 8 has a reduction drive 11 acting normal, that is perpendicular, to the feed direction 5 of the slab 2. In addition, a feed drive 12 acts parallel to the slab 2. Reduction drive 11 moves the corresponding die carrier 8 in the direction toward the slab for reducing the slab width and the drive has a guidance or steering system actuated by one of two eccentric shafts 13 containing connecting rods. Feed drive 12 acting in the direction of slab movement, engages at the die carrier 8 and abuts the crank housing 9. The two eccentric shafts 13 are supported in the crank housing 9 and are driven by universal shafts connected with a gear box 15 and a drive motor, note FIG. 2.

Figure 2:
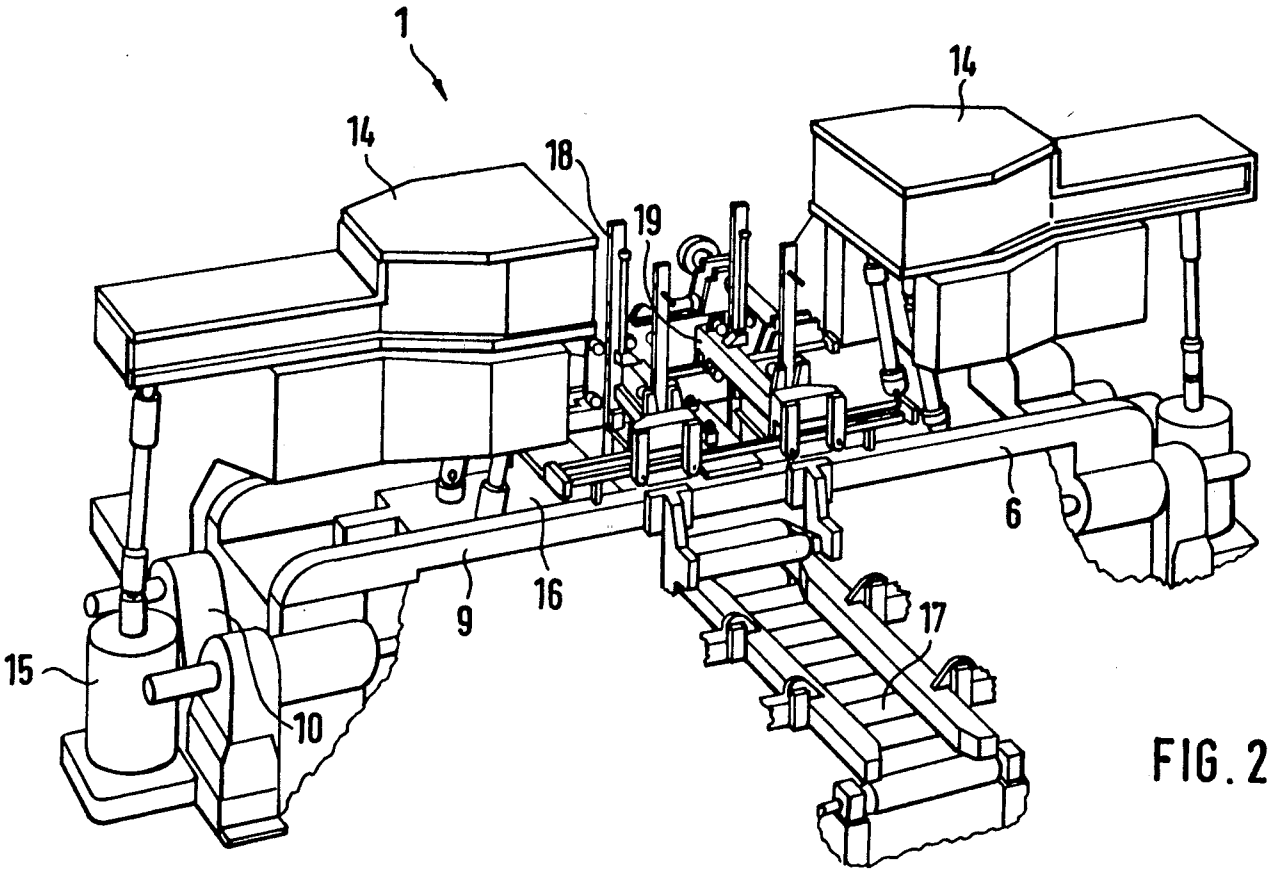
FIG. 2 is a perspective view of the upsetting press shown in FIG. 1 including two replacement devices for the pressing dies.

FIG. 2 is a perspective view of the upsetting press shown in FIG. 1 with the stand beams 6 arranged horizontally and transversely of the slab movement 5 and with the mechanical adjustment device 10 for the crank housing 9 where the reduction drive 11 is arranged. Further, the universal shafts 16 driving the eccentric shafts 13 can be seen with the universal shafts in connection with the gear box 14 and drive motor 15 through an additional transmission shaft. The slab to be width-reduced is moved into the upsetting stand on the roller table 17. As the slab 2 moves into the region of the pressing dies, the slab is upset along its side edges by the pressing dies 7 moving toward one another. For exchanging the highly stressed pressing dies 7, an automatically operated die replacement apparatus 18 is located in the region of the pressing dies and is formed by a separate replacement device for each pressing die. The details of the replacement devices will now be described.

Figure 3:
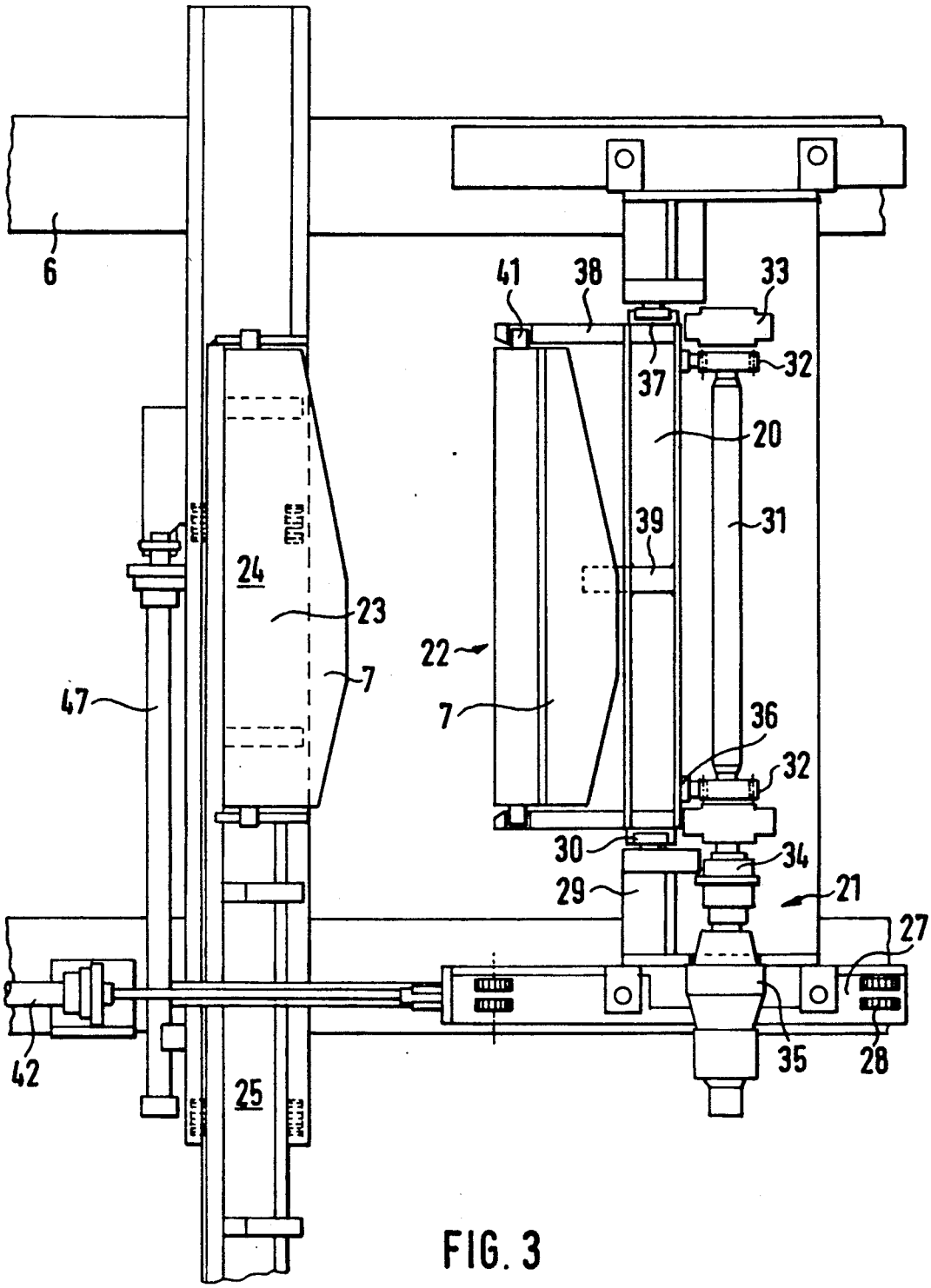
FIG. 3 is a plan view of one replacement device shown on an enlarged scale.
Figure 4:
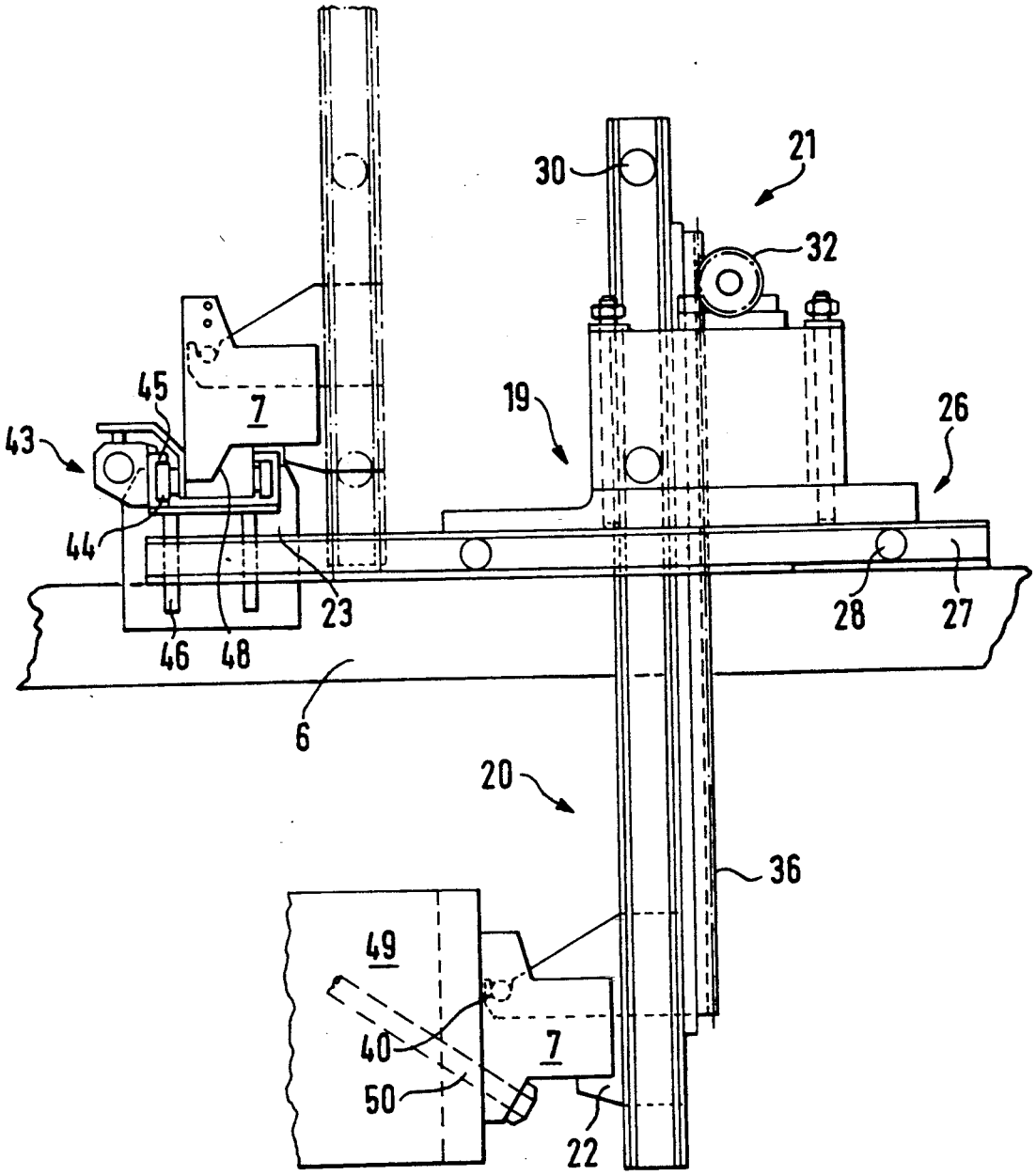
FIG. 4 is a side view of the replacement device illustrated in FIG. 3.

In FIGS. 3 and 4, the apparatus for replacing the pressing dies of the upsetting press is shown at an enlarged scale, as compared with FIG. 2, and each replacement device includes an upwardly extending hoisting frame 20 with a hoisting drive 21 for vertically displacing a mounting support 22 on the frame with the mounting support arranged to receive a pressing die 7. The hoisting frame 20 is movably displaceable by a displacement trolley 19, note FIG. 4 and a displaceable carrier trolley 23 extends transversely of the stand beams 6 and has two depositing locations 24, 25 for receiving a pressing die 7. Displacement trolley 19 is movable along a rail arrangement 26 including a rail guide 27 with travelling rollers 28 extending along the stand beams 6. Accordingly, the displacement trolley 19 can be moved from the operative position of the pressing die 7 to the location of the carrier trolley 23. A beam construction 29 with guide rollers 30 for the hoisting frame is secured at the displacement trolley 19, so that the hoisting frame along with the mounting support 22 of the pressing die can be raised and lowered through a window defined between the stand beams 6.

Hoisting drive 21 for the hoisting frame 20 includes two pinions 32 located at opposite ends of a connecting shaft 31. Connecting shaft 31 is supported in pedestal bearings 33 and is driven through a coupling 34 by a hydraulic motor 35 located on the displacement trolley 19. Each pinion 32 of the hoisting drive meshes with a corresponding toothed rack 36 located on the hoisting frame 20 and arranged vertically relative to the horizontal window located between the stand beams 6. Hoisting frame 20 has two guide rails 37 on opposite sides of the frame inwardly of the guide rollers 28 of the beam construction 29 of the displacement trolley 19. The hoisting frame 20 with its support mounting 22 can be lowered into the region of the pressing die 7 by the hoisting drive 21 and the connection between the hoisting frame and the displacement trolley. The support mounting 22 for the pressing die 7 has a side strap 38 at each of its opposite ends for engaging the pressing die 7 and a central strap 39, spaced between the side straps 38, and arranged to extend below and afford support for the pressing die. Each side strap 38 of the support mounting 22 has a recess 40 for receiving a carrier pin or bolt 41 arranged at the end of the pressing die 7. The shape of the recess 40 can be seen best in FIG. 4.

Displacement trolley 19 is movable along a rail arrangement secured along the stand beams 6 and is moved by a travel-controlled displacement device 42, such as a double-acting piston cylinder unit using a hydraulic medium. As shown in FIG. 3, the rail arrangement and the travel-controlled displacement device 42 are supported on the stand beam 6 of the press stand. Displacement trolley 19 can be moved toward the carrier trolley 23 by the displacement device 42. Carrier trolley 23 is movable over a separate rail arrangement 43, note FIG. 4, extending transversely of the stand beams 6. Wheels 44 of the carrier trolley 23 roll in guide rails 45 connected to a transverse tie 46 attached to and extending between the sides of the stand beams 6. The carrier trolley 23 is movable along the rail arrangement 43 by another travel-controlled displacement device 47 into predetermined positions. As shown in FIG. 3, a depositing location 24 has received a worn pressing die 7 removed from the upsetting press. Another depositing location 25 is spaced laterally from the location 24 for receiving a reworked pressing die to be placed on the die carrier 8. The support surfaces 48 of the depositing locations 24, 25 are shaped to conform to the shape of the pressing die.

The following is a description of the replacement of a pressing die in the upsetting press.

Displacement trolley 19 is moved by the displacement device 42 along with the hoisting frame 20 operated by the hoisting drive 21 into position for removing a worn pressing die 7 from the upsetting press. When the displacement trolley is positioned, the hoisting drive 21 lowers the hoisting frame 20 into the window defined by the stand beams 6 for receiving a worn pressing die 7 with the support mounting 22 on the hoisting frame engaging the pressing die. The pressing die 7 is clamped to the die carrier 8 by spring force and is detached hydraulically while the anchoring ties 50 with hammerheads, note FIG. 4, are turned through 90° by a rotational device so that the pressing die is released for removal. The carrier pins 41 of the released pressing die 7 are supported in the recesses 40 of the side straps 38 of the support mounting 22 and the die is also supported on the central strap 39. The pressing die 7 is lifted, supported by the support mounting 22 on the hoisting frame 20, with the lifting being carried out by the hoisting drive 21. The displacement trolley 19 is moved by the displacement device 22 toward the carrier trolley 23 carrying the hoisting frame 20 and the removed pressing die 7. The removed pressing die 7 is placed upon an empty depositing location 24 of the carrier trolley 23. The displacement trolley 19 moves back away from the carrier trolley 23 and the transverse movement of the replacement pressing die into position to be picked up is effected by the movement of the carrier trolley 23 caused by the displacement device 47. The replacement pressing die 7 is now in position to be picked up and the displacement trolley 19 is again moved toward the carrier trolley 23 and, with its support mounting 22, picks up the replacement die from the other depositing location 25 and moves it back into position to be mounted on the die carrier. With the replacement pressing die seated on the die carrier, it is hydraulically clamped and secured by the anchoring ties 50. The displacement trolley 19 is then moved away from the die carrier and the hoisting frame 20 along with the support mounting 22 is moved upwardly out of the upsetting press into the original position. Accordingly, the pressing die removal and replacement in the upsetting press has been completed.

The replacement of the pressing dies 7 in the upsetting press is performed on the opposite sides of the slab independently of one another, since each side has its own replacement device of the replacement apparatus.

The removal of the worn pressing die from the carrier trolley 23 and the introduction of the replacement die is performed by an overhead crane, not shown, always in the same position. The removal and charging positions are attained by the transverse movement of the carrier trolley into a central position above the upsetting press and raising or lifting the die by means of the support mounting 22 on the hoisting frame 20. The carrier trolley is moved and the replacement die is placed on the depositing location 25 on the carrier trolley. Subsequently, the carrier trolley 23 is moved so that the depositing location 24 from which the worn pressing die has been removed, is located centrally above the upsetting press for receiving the next worn pressing die.

Completely automatically performed replacement of the pressing die in the upsetting press can be carried out by operating personnel from a control stand using the replacement devices as described above.

While the invention has been illustrated and described, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

I claim:

1. An apparatus for replacing pressing dies in an upsetting press used for width reduction of rolled material, such as the reduction of a slab width in a hot rolled wide strip shaping train, comprising:

a die carrier for each pressing die, wherein a pair of the pressing dies are mounted on the die carriers in operative positions facing one another on opposite sides of said slab to be width-reduced;

a drive system for moving the die carriers in a reciprocating direction towards and away from one another for reducing the width of the slab in a horizontal stand between horizontally extending, spaced, stand beams as the slab is fed along a path between the pressing dies, said die carriers being arranged between said spaced stand beams so that the die carriers and stand beams define a window;

at least one vertically extending hoisting frame having a hoisting drive arranged vertically above a retainer mounted on said frame for receiving the pressing die, wherein the retainer can be raised or lowered by an electric drive of the hoisting frame through the window in a direction towards and away from the pressing die, said vertically extending hoisting frame having a vertical length at least equal to a distance between the hoisting drive and retainer when said retainer is in its lowered position at a distance farthest from said hoisting drive;

a support mounting on said hoisting frame, said support mounting connecting said retainer to said hoisting frame;

a displaceable trolley supporting said hoisting frame wherein the hoisting drive for the hoisting frame is arranged on the displaceable trolley; and a displaceable carrier trolley spaced from the pressing die in the operative position thereof, said carrier trolley having at least one depositing location for receiving a pressing die from or supplying a pressing die to said support mounting.

2. The apparatus of claim 1, further comprising:

a horizontal rail arrangement, wherein said displacement trolley is movable on the horizontal rail arrangement extending along the stand beams;

a transverse rail arrangement extending transversely of said stand beams, wherein said carrier trolley is moveable in the horizontal direction on said transverse rail arrangement.

3. The apparatus of claim 2, further comprising:

first rails on said horizontal rail arrangement for said displacement trolley arranged on the horizontal stand beams; and second rails on said transverse rail arrangement for the carrier trolley positioned on a transverse tie connected to and extending transversely of said stand beams.

4. The apparatus of claim 3, further comprising:

a first travel-controlled displacement device, wherein said displacement trolley is displaceable by said first travel-controlled displacement device; and a second travel-controlled displacement device, wherein and said carrier trolley is displaceable by wherein and said carrier trolley is displaceable by said second travel-controlled displacement device.

5. The apparatus of claim 4, wherein each of said first and second travel-controlled displacement devices further comprises:

a double acting piston cylinder unit; and a pressure medium operating said double acting piston cylinder unit, wherein said unit for said first travel-controlled displacement device is mounted on and extending along the stand beans and said unit for the second travel-controlled displacement device mounted on and extending along the transverse tie.

6. The apparatus of claim 1, wherein said hoisting drive for the hoisting frame is positioned on the displacement trolley and the hoisting frame is retained on the displacement trolley in a roller guide.

7. The apparatus of claim 1 wherein said hoisting drive, further comprises:

a hydraulic motor with a gear box and impulse counter;

a connector coupling on a shaft supported in pedestal bearings mounted on said hoisting frame; and at least one pinion meshing with a toothed rack secured to said hoisting frame.

8. The apparatus of claim 1, wherein said support mounting for the pressing die, further, comprises:

two laterally spaced side straps arranged to engage carrier pins on the opposite ends of said pressing die; and a central strap positioned between said side straps for supporting said pressing die.

9. The apparatus of claim 8, wherein each said side strap of the support mounting has a recess therein for receiving the carrier pin located on and extending outwardly from an end of the pressing die.

10. The apparatus of claim 1, wherein said carrier trolley has two spaced depositing locations thereon spaced apart in a direction extending transversely of said stand beams, wherein each of said depositing location is arranged to support a pressing die.

11. The apparatus of claim 1, further comprising a replacement device, wherein said replacement device, comprises:

a displacement trolley; and a carrier trolley for each pressing die in the upsetting press.

12. An apparatus for replacing pressing dies in an upsetting press used for width reduction of rolled material, such as the reduction of a slab width in a hot rolled wide strip shaping train, comprising:

a die carrier for each pressing die, wherein a pair of the pressing dies are mounted on the die carriers in operative positions facing one another on opposite sides of said slab to be width-reduced;

a drive system for moving the die carriers in a reciprocating direction towards and away from one another for reducing the width of the slab in a horizontal stand between horizontally extending, spaced, stand beams as the slab is fed along a path between the pressing dies, said die carriers being arranged between said spaced stand beams so that the die carriers and stand beams define a window;

at least one vertically extending hoisting frame having a hoisting drive arranged vertically above a retainer mounted on said frame for receiving the pressing die, wherein the retainer can be raised or lowered by an electric drive of the hoisting frame through the window in a direction towards and away from the pressing die;

a support mounting on said hoisting frame, said support mounting connecting said retainer to said hoisting frame;

a displaceable trolley supporting said hoisting frame wherein the hoisting drive for the hoisting frame is arranged on the displaceable trolley;

a displaceable carrier trolley spaced from the pressing die in the operative position thereof, said carrier trolley having at least one depositing location for receiving a pressing die from or supplying a pressing die to said support mounting;

a horizontal rail arrangement, wherein said displacement trolley is movable on the horizontal rail arrangement extending along the stand beams;

a transverse rail arrangement extending transversely of said stand beams wherein said carrier trolley is moveable in the horizontal direction on said transverse rail arrangement;

first rails on said horizontal rail arrangement for said displacement trolley arranged on the horizontal stand beams; and second rails on said transverse rail arrangement for the carrier trolley positioned on a transverse tie connected to and extending transversely of said stand beams.

13. The apparatus of claim 12 further comprising:

a first travel-controlled displacement device, wherein said displacement trolley is displaceable by said first travel-controlled displacement device; and a second travel-controlled displacement device, wherein and said carrier trolley is displaceable by said second travel-controlled displacement device.

14. The apparatus of claim 13, wherein each of said first and second travel-controlled displacement devices further comprises:

a double acting piston cylinder unit; and a pressure medium operating said double acting piston cylinder unit, wherein said unit for said first travel-controlled displacement device is mounted on and extending along the stand beams and said unit for the second travel-controlled displacement device mounted on and extending along the transverse tie.

* * * * *